US005120055A

United States Patent [19]

McCarthy et al.

[11] Patent Number: 5,120,055

[45] Date of Patent: Jun. 9, 1992

[54] DETACHABLE HOCKEY TRAINER

[76] Inventors: Shawn P. McCarthy; Victoria M. McCarthy; John P. McCarthy, all of 12 Baltusrol Dr., Clifton Park, N.Y. 12065

[21] Appl. No.: 732,833

[22] Filed: Jul. 19, 1991

[51] Int. Cl.[5] ..... A63B 59/14

[52] U.S. Cl. ..... 273/57.2; 273/58 C; 273/67 A; 273/414

[58] Field of Search ..... 273/57.2, 67 A, 413, 273/414, 58 C, 200 R, 198 R

[56] References Cited

U.S. PATENT DOCUMENTS 1,579,294 4/1926 Fisk ..... 273/200 R
3,863,917 2/1975 Beale ..... 273/57.2
4,023,797 5/1977 Sarrasin ..... 273/57.2
4,071,241 1/1978 Garcia ..... 273/58 C X
4,111,419 9/1978 Pellegrino ..... 273/57.2
4,793,612 12/1988 Hammond ..... 273/26 E

*Primary Examiner*—Paul E. Shapiro
*Attorney, Agent, or Firm*—Richard C. Litman

[57] ABSTRACT

A practice hockey puck is connected to the blade of a hockey stick by a removable elastic cord in such a way as not to alter the characteristics of either the hockey puck or the hockey stick. The puck and the tether are easily attached or removed from the hockey stick and in no manner is the stick altered. The device allows for an easy way of training and practicing stick handling and puck control without the need for a partner and without specialized equipment.

5 Claims, 1 Drawing Sheet

FIG. 1
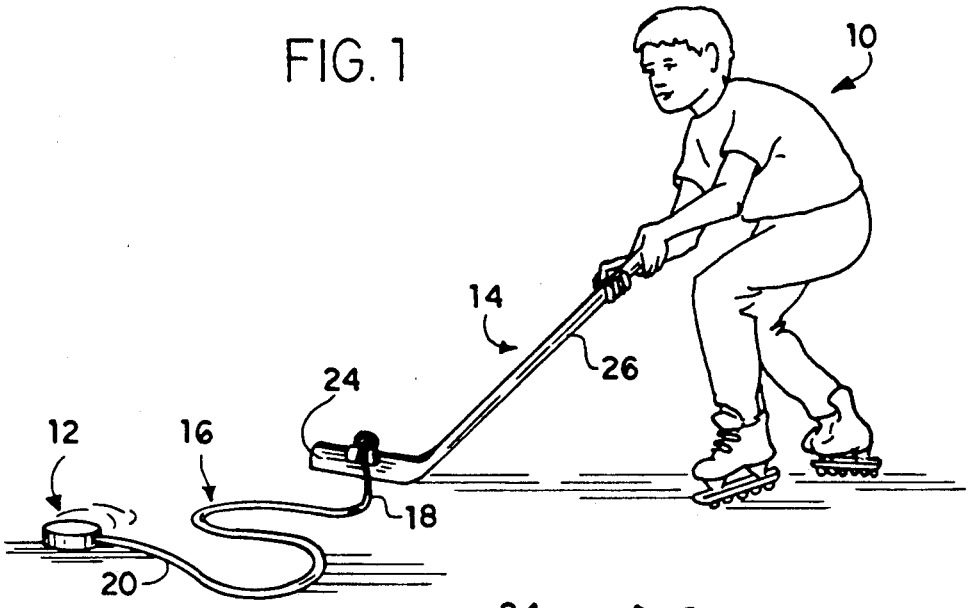
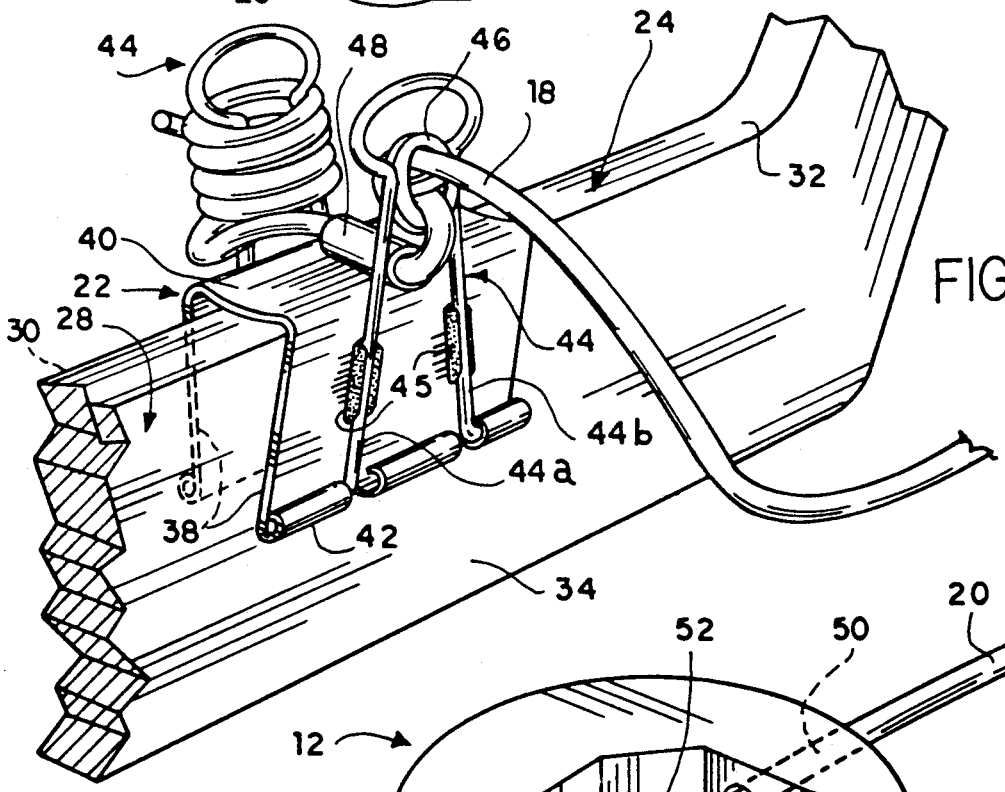
FIG. 2
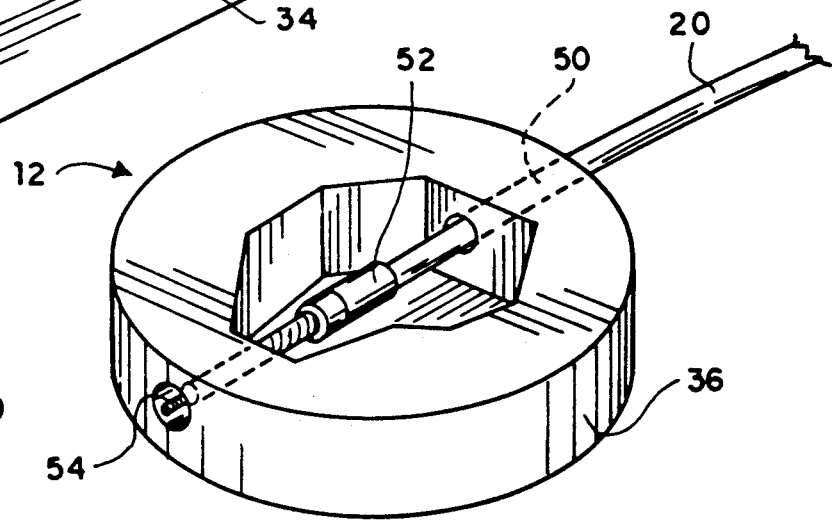
FIG. 3

DETACHABLE HOCKEY TRAINER

FIELD OF THE INVENTION

The present invention relates to hockey equipment. More particularly this invention is directed to hockey training devices which are detachable and in no way permanently alter the existing hockey stick.

DESCRIPTION OF THE PRIOR ART

Hockey training devices in general are known. U.S. Pat. No. 3,863,917 issued to Beale disclose a hockey training stick. The device is comprised of a hockey stick with a plurality of apertures in the blade of the stick, a puck, and a elastic cord for detachably connecting the puck to the blade of the stick through one of the apertures.

U.S. Pat. No. 4,023,797 issued to Sarrasin disclose a hockey puck tethering device which is attached to the shaft of a hockey stick by means of a reel and spool assembly. The tether is connected to the reel for variable length. The tethering line is protected by a protrusion type shock absorber arrangement at the opening to the reel assembly as well as the connection to the puck.

U.S. Pat. No. 4,111,419 issued to Pellegrino discloses a practice hockey puck for use in individual practice on surfaces other than ice. The puck is remotely coupled with an elastic cord which in turn includes a screw type fastening device at the opposite end for fastening to the blade of the hockey stick. The puck is a standard hockey puck altered so as to have a plurality of headed pins disposed about the periphery of the two flat surfaces so the majority of the weight of the hockey puck is supported on these pins.

None of the above referenced devices, considered either singly or in combination, is seen to suggest the instant invention as claimed.

SUMMARY OF THE INVENTION

The invention consists of a clip type mechanism, detachable elastic cord and hockey puck. The cord is attached by a clip on the blade of the hockey stick and is further connected to the hockey puck. The clip is attached to the hockey stick blade in a non-invasive and non-destructive manner. The invention is designed to be used on any type of hockey stick, without modifying or altering the stick in any way. This device will have application in the areas of ice hockey, street hockey (with rollerblades), field hockey, indoor gym hockey, and in the adaptive physical training of the disabled. The object of this invention is to serve as a training device which allows the individual hockey player to practice stick handling and puck control in such a manner to preclude the need for a partner. In addition, it precludes the need to chase after and retrieve loose pucks thus saving valuable training time. It also decreases the danger of injury caused by out of control pucks during training sessions.

The clip element can be placed in different locations on the blade of an ordinary hockey stick. The placement of the clip on different sides of the blade will provide both forehand and backhand skill training.

Accordingly, one object of the present invention is to provided a device which is easily attached and removed from an existing hockey stick in a manner which does not alter the hockey stick in any way.

Another object of the invention is to provide a puck which is attached the tether in such a manner as to not alter its surface characteristics.

Another object of the invention is to provide an easy to use and simple tether adjustment system connected to the clip on portion of the device.

These and other objects of the present invention will become readily apparent upon further review of the following specification and drawings.

BRIEF DESCRIPTION OF THE DRAWINGS

FIG. 1 is a perspective illustrating the invention in use;

FIG. 2 is a partial perspective view of the clip attachment of the tether to the stick; and FIG. 3 is a cut away view of the puck and tether attachment.

Similar reference characters denote corresponding features consistently throughout the attachment drawings.

DETAILED DESCRIPTION OF THE PREFERRED EMBODIMENT

FIG. 1 depicts a player 10 utilizing the present invention in the practice of improving their skills in street hockey and will be seen to illustrate a puck 12 as captively joined to a hockey stick 14, by means of a tether 16. The tether comprises a flexible, elongated, elastic member having a leading end 18 adjustably and removably affixed to the hockey stick 14 in the manner shown in FIG. 2 while the opposite, trailing end 20 is attached to the puck 12 as shown clearly in FIG. 3.

The connection of the tether leading end 18 to the stick 14 is accomplished by means of an attachment member 22 comprising a spring clip which will be understood to be removably and adjustably attachable to the blade 24 at the end of the stick handle 26. With this arrangement, a non-invasive and non-destructive attachment is achieved, avoiding any alteration of the stick as well as any interference between a blade face 28, 30 and the puck 12, during play. This latter feature is due to the location of the attachment member 22 adjacent the top edge 32 of the stick blade, thereby leaving the lower portion 34 of the blade faces fully clear of any obstructions, so that when the periphery 36 of the puck 12 is struck, a realistic trajectory will be achieved.

The attachment member 22 includes a spring clip, commonly referred to as a binder clip, having a body comprising a pair of legs 38,38 and an intermediate wed 40. The edges 42,42 of the clip edges are normally biased towards one another and are spread apart by applying a compressing action upon the ends of two actuating arms 44,44. In the use position of FIG. 2, it will be appreciated that a significant clamping action is achieved as the clip edges 42 tightly grasp the faces 28,30 of the stick blade as the web 40 abuts the blade top edge 32.

The tether leading end 18 is affixed to the attachment member 22 by passing it through the bifurcated elements 44*a* and 44*b* of one of the actuating arms 44. A slip ring or other type of retaining fastener then engages the tether to limit the effective length of the tether, between the stick and puck. Thence, the tether is passed through a guide tube 48, following which it is suitably wrapped about the outer clip arm 44. With this construction, the effective length of the tether may be altered according to the desires of the user and any shortening or lengthening of the tether will obviously vary the resultant action between the stick and puck. To preclude the clip arm 44 from being pulled away from the adjacent clip leg 38 due to tension as applied by the tether 16, the arm 44 may be suitably secured to the leg, as by the welds 45.

The trailing end 20 of the tether is secured to the puck by means of a threaded fastener engaging a tapped member carried by the end of the tether. As shown in FIG. 3, the puck 12 is provided with a transverse or diametrical bore 50 for the containment of the tether end. The tapped member 52 is inserted into the bore 50 from one end and then retained by means of a cooperating threaded fastener 54 having its head recessed within or flush with the puck periphery 36 for obvious reasons.

The manner of employing the assembly of the invention will now be readily appreciated. A user may quickly affix the leading end of a tether 16 to the top edge 32 of a hockey stick blade 24 by means of the attachment member 22 and readily assures that the length of the tether is as desired, by slipping it through the retainer ring 46. This mounting of the clip 22 is made at any desired point along the length of the blade according to the wishes of the user, so that the resultant action and reaction between the stick and tethered puck may be selectively made. With a player 10 approaching the puck 12 as in FIG. 1, the lower portion 34 of the blade face 28 is swung toward the puck as the stick is manipulated in a manner intended to direct the puck in a particular direction. Upon striking the puck, the impact directs the puck while the tether becomes straightened. Depending upon the force applied by the stick impact, the puck may pull the tether against its elasticity and this action will be understood to produce a unique reaction as the rebounding tether 16 delivers an unpredictable trajectory to the puck. Thus, varying the mounting point of the attachment member 24 along the length of the stick blade, altering the effective length of the tether at its leading end 18 and/or varying the striking force applied to the puck, all may be calculated to provide for various modes of play or test of skills.

It is to be understood that the present invention is not limited to the sole embodiment as described above, but encompasses any and all variations falling within the scope of the appended claims.

We claim:

1. A hockey training apparatus comprising;

a hockey stick having a handle joined to a blade provided with opposite faces having a top edge and lower face portions, a puck adapted to be struck by at least one said blade face, a tether joining said puck to said stick blade, said tether including a flexible elongated member having leading and trailing ends, an attachment removably connected to said blade, said attachment member includes a spring clip having two legs joined to a central web.

actuating arms attached to said legs and displaceable to open said legs against an inherent biasing force, means on said attachment member receiving said tether leading end, said puck including a bore disposed diametrically there-through, said tether trailing end disposed within said bore, and fastener means insertable within said bore and engageable with said tether trailing end to secure said trailing end to said puck.

2. A hockey training apparatus according to claim 1 wherein, said tether includes an elastic composition.

3. A hockey training apparatus according to claim 1, wherein, said receiving means on said attachment member includes a slip fastener allowing of shortening and lengthening of said tether leading end there-through.

4. A hockey training apparatus according to claim 1 wherein, said insertable fastener means includes a pair of cooperating threaded members.

5. A hockey training apparatus according to claim 1 including, a guide tube affixed to said clip web, and said tether leading end disposed through said guide tube.

* * * * *